US005820125A

United States Patent [19]

Olsen

[11] Patent Number: 5,820,125

[45] Date of Patent: Oct. 13, 1998

[54] BOARD GAME

[76] Inventor: M. Ardell Olsen, 1117 E. Country Hills Dr., Suite 9, Ogden, Utah 84403

[21] Appl. No.: 883,206

[22] Filed: Jun. 26, 1997

Related U.S. Application Data

[60] Provisional application No. 60/021,996 Jun. 27, 1996.

[51] Int. Cl. [6] ..... A63F 3/00

[52] U.S. Cl. ..... 273/248; 273/272

[58] Field of Search ..... 273/242, 243, 273/248, 249, 272, 429, 430, 431, 432

[56] References Cited

U.S. PATENT DOCUMENTS

| | | | |
|---|---|---|---|
| D. 33,057 | 8/1900 | Pennell . | |
| 3,649,022 | 3/1972 | Clark, Jr. . | |
| 3,926,438 | 12/1975 | Breslow et al. . | |
| 3,984,106 | 10/1976 | White . | |
| 4,157,183 | 6/1979 | Meyer et al. . | |
| 4,930,788 | 6/1990 | Roccanova | 273/248 |
| 5,048,842 | 9/1991 | Proctor . | |
| 5,269,530 | 12/1993 | Miller | 273/272 X |
| 5,377,991 | 1/1995 | Olsen . | |
| 5,433,450 | 7/1995 | Vaillancourt | 273/248 |
| 5,564,710 | 10/1996 | Bolding et al. | 273/272 X |
| 5,645,280 | 7/1997 | Zelmer | 273/272 X |
| 5,692,753 | 12/1997 | Falk | 273/248 |

*Primary Examiner*—William E. Stoll
*Attorney, Agent, or Firm*—Thorpe, North & Western, L.L.P.

[57] ABSTRACT

A board game is disclosed wherein a player must move a token through a plurality of playing fields and return to a starting position. Movement between playing fields is conditioned on the successful completion of a requirement such as correctly answering a question or collecting a plurality of tiles in a desired combination. The first player to pass through each of the playing fields and return to the starting position is declared the winner.

16 Claims, 2 Drawing Sheets

BOARD GAME

RELATED APPLICATIONS

This is an application filed under 35 U.S.C. §111(a) for an invention which was disclosed in Provisional Application Ser. No. 60/021,996, filed under 35 U.S.C. §111(b) on Jun. 27, 1996, no more than twelve (12) months from the filing date of this §111 (a) applications.

BACKGROUND OF THE INVENTION

1. Field of the Invention

The present invention relates to a new board game and a method for playing the same. More particularly, the invention relates to a board game which tests knowledge of the Bible or some other material while the player attempts to move about a plurality of advancement tracks to determine a winner.

2. State of the Art

There are numerous board games wherein competing contestants attempt to outmaneuver the other contestant or contestants in order to accomplish the goals of the game. In recent years, however, the trend among game players has been away from these traditional games of strategy and toward games which are based on knowledge of trivia and related matters. Usually the trivia relates to matters such as science, the arts, entertainment, history and other subjects taught in school or the subject of common conversation. There are, however, few games which help young people and adults alike to learn about matters such as the Bible or other subjects which are not taught in most schools and which are often not the subject of common conversation.

Thus, there is a need for a board game which will assist players in developing a better understanding of the subject matter of the game, and in particular the Bible. Such a game should be challenging and enable the player to learn not only trivia from the Bible, but also the general principles which are taught therein. Such a game should also be relatively simple so that it can be played by small children and the like.

SUMMARY OF THE INVENTION

Thus, it is an object of the present invention to provide a new board game which combines the need for knowledge of the Bible or some other chosen material with a novel and interesting playing board so as to make the game fun and challenging.

It is another object of the present invention to provide such a game wherein the general principles of the Bible can be taught in addition to trivia relating thereto.

It is still another object of the present invention to provide a playing board which can be used with other trivia games to increase the challenge thereof.

The above and other objects of the invention are realized in specific illustrated embodiments of a board game and method for playing the same which includes a board having an advancement track with at least two playing fields and at least one beginning location for each field. Typically, an intermediate position on one playing field will serve as a beginning position on another playing field. In order to prevail, a player must move a movement piece or token through each of the playing fields and back to the that player's beginning position.

In order to advance along the playing field the player must successfully complete a requirement, such that the successful answering of a question. The player must also roll the dice in such a manner than he or she properly positions his or her token for movement through the respective playing fields.

In accordance with one aspect of the invention, the game board has a "phrase maze" disposed thereon such that a player who successfully draws tiles in a desired combination completing a phrase on the phrase maze is given an advantage in movement between playing fields and back to the beginning position. In order to obtain the advantage, the player must position his or her tiles in such a manner to complete a phrase drawn from the teachings of the Bible, as opposed to points of trivia.

In accordance with another aspect of the invention, a plurality of designated squares are provided for enabling players to increase the number of tiles for use on the phrase maze to maximize the likelihood that the player will obtain an advantage.

In accordance with another aspect of the present invention, a player who has moved his or her token during the turn must play at least one tile on the phrase maze, either completing a phrase and obtaining an advantage, or facilitating the ability of other players to complete a phrase.

BRIEF DESCRIPTION OF THE DRAWINGS

The above and other objects, features and advantages of the invention will become apparent from a consideration of the following detailed description presented in connection with the accompanying drawings in which.

DETAILED DESCRIPTION

Reference will now be made to the drawings in which the various elements of the present invention will be given numeral designations and in which the invention will be discussed so as to enable one skilled in the art to make and use the invention. It is to be understood that the following description is only exemplary of the principles of the present invention, and should not be viewed as narrowing the pending claims.

Figure 1:
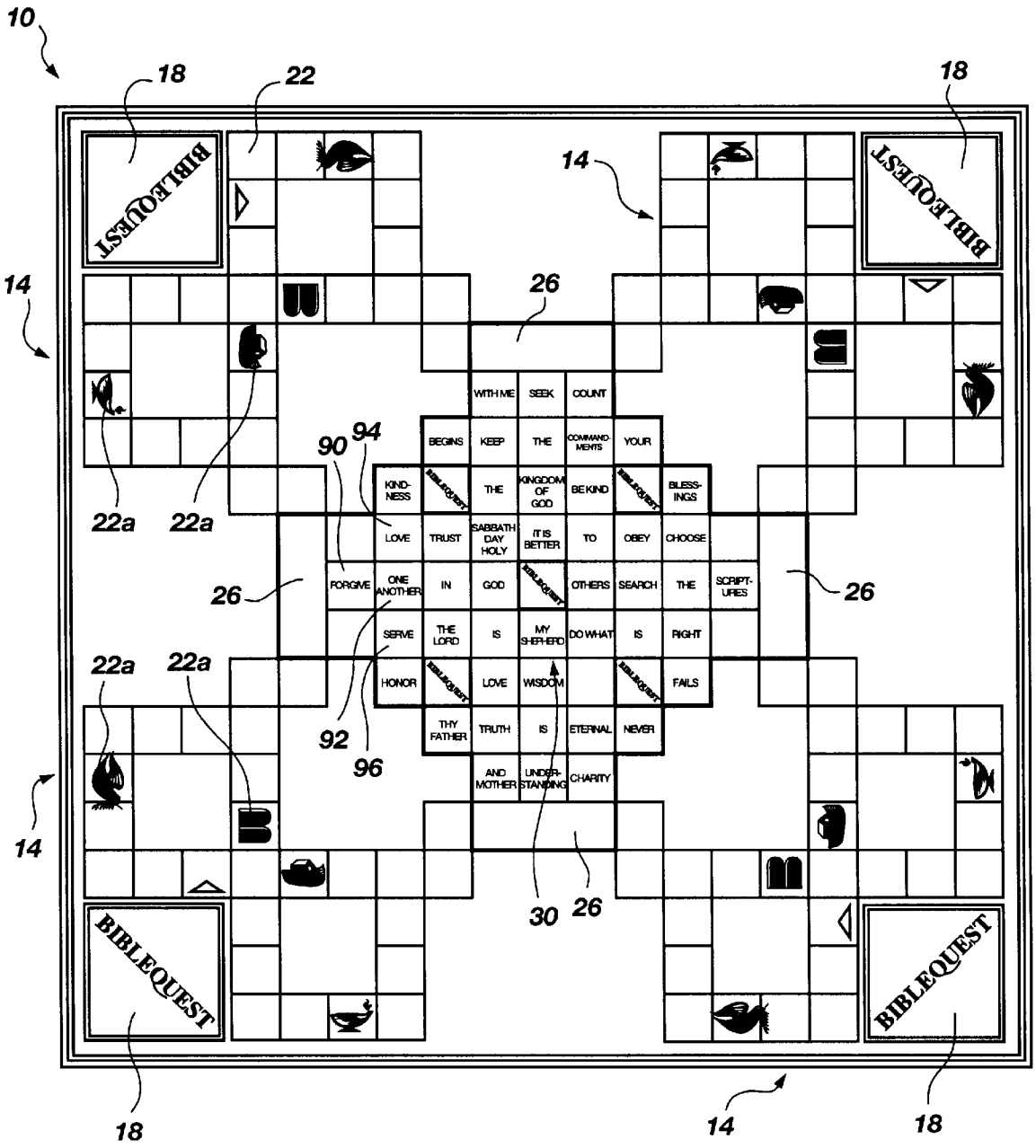
FIG. 1 shows a plan view of a game board made in accordance with the teaching of the present invention.
Figure 2:
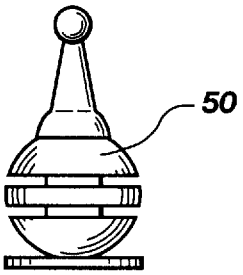
FIG. 2 shows a token as may be used to indicate the position of a player on the game board of FIG. 1.

Referring to FIG. 1, there is shown a plan view of a game board, generally indicated at 10, for use with the present invention. The game board 10 is divided into four game playing fields, each generally indicated at 14. Each playing field includes a home base 18 which serves as a starting and ending position for a player. Typically four different colors are used for the home bases 18, and a like colored token (indicated at 50 in FIG. 2) is assigned thereto. Each playing field 14 also includes a plurality of squares, movement squares, such as square 22. The majority of squares 22 are blank. Approximately four squares per playing field 14 are provided with a design indicating them to be action squares, indicated in FIG. 1 at 22*a*.

When a player's token lands on a blank square, such as square 22, nothing happens. However, when a player lands on an action square, such as those designated 22*a*, the player whose token has landed on the square is allowed to draw additional tiles. The purpose of the tiles is discussed in detail below. The action squares 22*a* will typically be designated by designs associated with the Bible. For example, as shown in FIG. 1, each of the action squares has a design chosen from a lamp, a dove, a pair of stone tablets and an ark.

Figure 3:
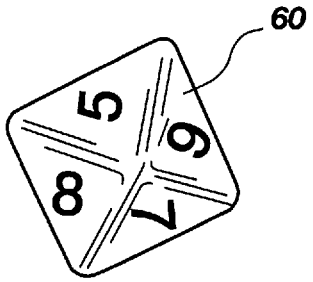
FIG. 3 shows an eight sided die which may be used to define the number of spaces a token may be moved if the designated requirements are met.
Figure 4:
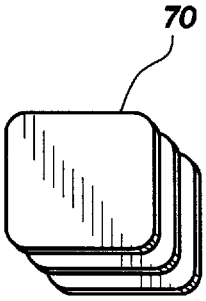
FIG. 4 shows a tile which is used to complete phrases on the game board.

The player attempts to traverse his or her playing field and move to the playing field to the right. In order to move into the next playing field, the player must roll a die (indicated at 60 in FIG. 3) in such a manner that his or her token is moved onto a bridge 26. In the alternative, the player may move his or her token onto the appropriate bridge if the player completes a phrase on the phrase maze 30. By landing on action squares, the player improves his or her ability to complete a phrase on the phrase maze 30 because he or she is generally able to increase the number of tiles (indicated at 70 in FIG. 4) which he or she holds. By increasing the number of tiles, the player has a greater selection of tile from which a phrase may be completed. Each tile will have one or more words which can be used to complete one or more of the phrases in the phrase maze 30.

If the player is able to complete a phrase on the phrase maze 30 or to roll the die 60 to move his or her tile onto the bridge 26 leading into the next playing field 14. The player then tries to move through the next playing field 14 and onto the next bridge 26. The winner of the game is the first person to successfully move his or her token 50 through each of the playing fields 14 and back into his or her home base 18.

Figure 5:
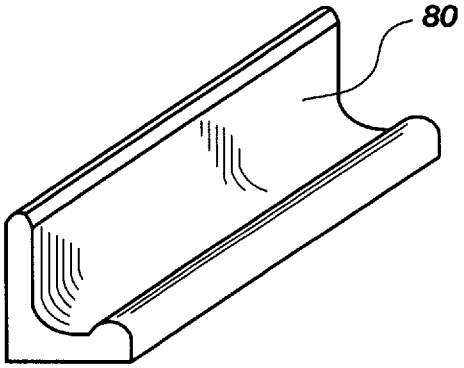
FIG. 5 shows a tile holder used to hold the player's tiles.

To increase the challenge of the game and to increase the knowledge of those playing the game with respect to the Bible, each turn is begun by asking a question from the Bible to the person playing the game. At the beginning of the game, each of the players draws five tiles 70 and places them on the rack (indicated at 80 in FIG. 5). The die 60 is then rolled to determine which player will go first.

At the beginning of each turn for each player, a question relating to the Bible (or some other matter if the board is used for other types of trivia) is asked. If the player successfully answers the question, the player draws a tile 70 (shown in FIG. 4) to bring the total number to six. The player then rolls and moves his or her token 50 accordingly. To keep players from storing tiles 70, a player must place one tile on the phrase maze 30 at the end of each turn. If the player is able to complete a phrase in the phrase maze 30 by placing one or more tiles 70 thereon, he or she may by-pass rolling and automatically move his or her token to the bridge at the end of the playing field 14 which his token 50 is currently on. If the token has returned all the way to the player's original playing field 14, the token 50 is advanced to that player's home base and the game is over for that player. The first player to reach his or her home base is declared the winner. The game may be stopped at that point, or each of the remaining players may be allowed to finish.

As was mentioned previously, the action squares 22*a* provide a player with an advantage. When a player lands on an action square 22*a*, the player is allowed to draw additional tiles until he or she has six tiles. With more tiles, the player has additional chances at completing a phrase on the phrase maze 30, thereby increasing the chance at moving directly to the next bridge 26 or to the player's home base 18.

The phrases written in the phrase maze 30 are drawn from the general teachings of the Bible instead of referring to facts selected therefrom. If other works are referred to, such as other religious teachings, the a phrase maze can be provided which relates thereto. Thus, for example, the game could be played using sayings of Confucius, or sayings from a famous authors such as Shakespeare.

The phrases in the phrase maze 30 are disposed in a similar manner to the words of a cross-word puzzle. The phrases overlap so that a single word or group of words is used for more than one phrase. For example to the left of the phrase maze 30 in FIG. 1 is a first square 90 with "forgive" written thereon, a second square 92 with "one another" written thereon, a third square 94 with "love" written thereon, and a fourth square 96 with "serve" written thereon. A first player may place a tile 70 having "love" written on the tile on square 94 and a tile with "another" written thereon on square 92. The player is then able to move to the next bridge. When a player get a tile having "forgive" written thereon, the player can complete a phrase with the existing tile on square 92, thereby entitling the player to move to the next bridge or to his or her home base 18.

THE GAME BOARD

Home Base: At each corner of the board is a large square (red, green, blue, or yellow). Each home base corresponds with one of the four colored playing pieces.

Playing field: The network of white squares just outside each home base constitutes the four playing fields.

Action Squares: Within each playing field, there are four colored playing spaces called action squares; they are identified with the Biblical symbols of a dove, ark, stone tablets and a lamp.

Bridge: Each playing field is connected by rectangular playing spaces called bridges.

Phrase Maze: At the center of the game board is the phrase-making area of color-coded words called the phrase maze. During game play, identical game tiles are laid down on this area to complete phrases such as "Kindness Begins With Me" or "Truth Is Eternal".

OBJECTIVE

The object of the game is to be the first player to pass through all four playing fields and return to home base. In order to leave one playing field and enter the next, the player's pawn must come to rest on the bridge separating the playing fields. You may move your pawn to this bridge: (1) by exact roll of the die, or (2) by completing a phrase on the phrase maze. Motion from one playing field to the next is always in a clockwise direction.

PLAYING THE GAME

Two to four players can play, or teams of players can be formed to involve larger groups or to pair adults with young children. The player's play the game as follows:

The initial step is for each player to select a colored player pawn and place it on the home base of the same color, and to place all of the colored game tiles face down. The colored game tiles are then mixed-up to form a random draw pile.

Each of the player then draws five tiles from the draw pile and rolls a dice to select the player who will begin the game.

The first player then commences his or her turn. One of the other players or a person not playing reads a question to the first player. If the first player answers correctly, he or she rolls the die. If answered incorrectly, the player's turn is over, and play is passed to the person on the left.

After answering a question correctly and rolling the die, the player moves his or her pawn the corresponding number of spaces from that player's base into the playing field, beginning at the enter/exit space which is indicated by a small arrow. Within each playing field the player can move his or her player pieces either to the left or to the right, but not back and forth during the same move.

Landing on the bridge: The player's immediate goal is to land, by exact count, on this space. The player can then move into his or her second playing field on that player's next turn.

Landing on an action square: If the player lands on one of these colored squares, the player can draw unused tiles from the draw pile to bring the total on the player's tray to six. Thus, the player is given an advantage in forming phrases.

Landing on a space occupied by another player's piece: If the player lands on an occupied spaced, the other player's piece is sent to the closest home base, and the player landing on the occupied space draws unused tiles from the draw pile to bring the total on his or her tray to six. The captured" player misses his next turn. An opponent's pawn cannot be captured while it is resting on an action square or on one of the bridges.

Landing on a blank playing square in the playing field: If a player lands on a plain white square, no particular benefit is gained besides being in position on your next turn to land on either an action square or a bridge.

After a player has rolled the die and moved that player's pawn, and picked up any unused tiles which may have been earned (review Step #6), the player now must play one or more tiles on the phrase maze to complete his or her turn. Thus, the player may either complete a phrase—playing one or more tiles—and move his or her player piece to the bridge, or play one tile (a discard) that does not complete a phrase, one that ideally will be of little benefit to the other players. Only one phrase can be played per turn. Typically, the game will include a list of approved phrases.

The first player to pass through each of the four playing fields and return home is the winner. Re-entering home base is accomplished: (1) by exact roll of the die passing through the enter/exit space, or (2) by completing a phrase while the player's pawn is (a) on the final bridge before the player's home playing field or on any square in your home playing field. It is not necessary to suspend game play at this point. The remaining players may choose to continue playing to determine the second, third, and fourth-place finishers.

The following is a list of the valid phrases which may be used for a Bible oriented game.

Be kind to others
God is love
Seek the Kingdom of God
Charity never fails
Honor thy father and they mother
Serve one another
Choose the right
It is better to obey
The Lord is my shepherd
Count your blessings
Keep the commandments
Trust in the Lord
Do what is right
Keep the Sabbath day holy
Truth is eternal
Forgive one another
Kindness begins with me
Wisdom is understanding
Search the scriptures
Love one another

GAME VARIATIONS

As players become more familiar with the game, the players may wish to adapt some of the rules to better meet their own preferences. The following are common variations that players may want to consider.

Chance Tiles: Included with the game are three red tiles with the name of the game on them. These may be used as chance tiles. Like a wild card, a chance tile can be substituted for any of the word tiles so the player can place a complete thought on the phrase maze sooner. For example, suppose the player has the tiles "Charity," "Never," and a "chance" title on his or her tray. The player could lay down the three tiles to form the expression "Charity Never Fails".

Note: Whenever the "Fails" tile shows up, it must be placed on the "phrase maze", replacing the "chance" tile, and the "chance" tile is removed from play, no benefit is gained from the replacement action.

A Helping Hand: If a player's pawn comes to rest on a space occupied by another player, the player may wish to demonstrate his or her compassion by lending a "helping hand" rather than "capturing" the opponent (as outlined above) Thus, the player may give away his or her right to replenish tiles to the "captured" player. When your turn is over pass the die to the next player. The player receiving the "helping hand" must wait until his or her next turn to lay down a phrase.

Young Players: Young children may find the game easier and more enjoyable if two choices instead of three are read after each question. This will give them a better chance of choosing the right answer to the question.

Scripture Study Companion: Consider reading the Bible or a favorite Bible story book before playing the game. For example, if the player's family has chosen to ask questions from the section on "Joseph In His Youth", read and study Genesis 30–41 as a family.

Quick game: Very often, it's nice to set down to an enjoyable family activity that doesn't involve a lot of time. Just follow all the game rules, but don't read and answer questions before each roll of the die. Action around the board will flow at a much faster pace and your children will love this version of the game.

POINTS TO CONSIDER

If there are too few tiles in the draw pile. When a player lands on an action square, he or she draws enough tiles from the draw pile to bring the total number on his tray to six. In the event that the number of tiles in the draw pile is insufficient, even after non-players have discarded their tiles, the player drawing is entitled only to what is available. For example, suppose a player's pawn has come to rest on an action square and the draw pile is depleted. The player's opponents each discard one tile to the draw pile. Even though the player may be entitled to more tiles, they player can collect only what is available. No more than one tile per opponent is discarded during that move.

After the player's turn is over, the die is passed to the next player. If the player's tiles create multiple phrases, only one phrase may be played per turn. Phrases can not be held over to be applied towards a subsequent turn. For example, if the tiles "Love" and "Serve" have been discarded, it is possible to create the phrases "Love One Another" and "Serve One Another" by simply adding the "One Another" tile. In this instance, the two phrases count as one.

Thus there is disclosed a new board game. Those skilled in the art will appreciate numerous modifications which may be made within the scope and spirit of the invention. The appended claims are intended to cover such modifications.

What is claimed is:

1. A method for playing a game using a game board having a player advancement track made up of sequential track segments and including beginning and ending positions and at least two intermediate playing fields which a player movement piece must traverse in sequence to reach the ending position, said method comprising the steps of:

(a) advancing a movement piece for each player along the player advancement track in a playing field in response to selection of a random number representing a number of track segments to be traversed by the movement piece in a given player turn;

(b) providing a plurality of related advancement indicator pieces which may be individually selected and arranged in a plurality of qualifying combinations to satisfy an advancement condition enabling movement of the player movement piece from a first playing field into a second playing field;

(c) sequentially imposing at least one requirement upon each player which, if successfully accomplished, entitles that player to randomly select and retain at least one of the advancement indicator pieces;

(d) arranging a plurality of the retained advancement indicator pieces into at least one of the qualifying combinations;

(e) advancing said movement piece from one playing field to another playing field upon a achievement of the qualifying combination; and (f) repeating any portion of steps "(a)" through "(e)" until the player piece traverses the advancement track to the ending position.

2. The method according to claim 1, wherein step (a) comprises, more specifically, imposing a requirement on a player which, is successfully accomplished, entitles the player to advance along the advancement track.

3. The method according to claim 2, wherein the requirement which must be successfully accomplished is answering a trivia question.

4. The method according to claim 3, wherein the trivia question is selected from the Bible.

5. The method according to claim 1, wherein providing advancement indicator pieces comprises, more specifically, providing a plurality of tiles, each tile having at least one word formed thereon.

6. The method according to claim 5, wherein the qualifying combination is a phrase formed from a plurality of tiles.

7. A game for at least one player to play which comprises:

a board having an advancement track with at least two playing fields and at least one beginning location;

means indicating at least one manner in which a plurality of related advancement indicators must be organized;

means for imposing at least one requirement upon each player in turn which, if successfully accomplished, entitles that player to randomly select at least one advancement indicator;

at least one movement piece for each player to move, said piece being initially placed at said beginning location and for advancing from one playing field to another playing field upon a player organizing selected advancement indicators in an indicated manner.

8. A method for at least one player to play a game using a game board having a player advancement track including a plurality of movement positions for a player piece which extend along said track and include (i) a beginning position, (ii) at least two sequential playing fields which the player piece must traverse, (iii) an intermediate bridge separating the at least two sequential playing fields, and (iv) an ending position which identifies a winning status, said method comprising the steps of:

(a) providing a plurality of advancement indicator pieces which represent individual component parts of qualifying combinations of the advancement indicator pieces which enable a player to advance forward to a next intermediate bridge or playing field;

(b) placing a movement piece for each player upon a beginning location of the track in a playing field;

(c) imposing at least one requirement upon each player in turn which, if successfully accomplished, entitles that player to randomly select at least one advancement indicator piece;

(d) advancing said movement piece from one playing field to an intermediate bridge as a required starting position for entry into another playing field upon a player organizing selected advancement indicator pieces into at least one of the qualifying combinations.

9. The method according to claim 8, wherein step (a) comprises, more specifically, providing a plurality of tiles, each tile having at least one word written thereon, the words written on the tiles being combinable with words on other tiles so as to form a phrase.

10. The method according to claim 9, wherein the method further comprises providing a list of phrases which, if formed by combining tiles, entitles the player to advance to a subsequent playing field.

11. The method according to claim 10, wherein all of the phrases on the list are selected from a desired topic.

12. The method according to claim 8, further comprising providing a random numeral selection means for indicating a distance within a playing field which the player may move.

13. A game for at least one player to play which comprises:

a board having an advancement track with at least two playing fields, at least one beginning location, and at least one intermediate location as a starting position for entry into another field;

means indicating at least one manner in which a plurality of related advancement indicators must be organized;

means for imposing at least one requirement upon each player in turn which, if successfully accomplished, entitles that player to randomly select at least one advancement indicator;

at least one movement piece for each player to move, said piece being initially placed at said beginning location and for advancing from one playing field to said at least one intermediate location upon a player organizing selected advancement indicators in an indicated manner.

14. The game of claim 13, wherein the advancement track comprises at least four playing fields, and wherein the fields are configured to form a loop such that a player advancing through each of the playing fields returns to the beginning position.

15. A method for at least one player to play a game with a game board having at least one plat and a player advancement track, said track having at least two playing fields, a beginning location and an intermediate location, said method comprising the steps of:

(a) indicating on said plat at least one pattern in which a plurality of related advancement indicators must be organized;

(b) placing a movement piece for each player upon a beginning location of the track in a playing field;

(c) imposing at least one requirement upon each player in turn which, if successfully accomplished, entitles that player to randomly select at least one advancement indicator;

(d) advancing said movement piece from one playing field to another playing field upon a player placing at least one advancement indicator on said plat thereby completing said at least one pattern.

16. A game for at least one player to play which comprises:

a board having at least one plat indicating at least one pattern in which a plurality of related advancement indicators must be organized and an advancement track with at least two playing fields, at least one beginning location, and at least one intermediate location as a starting position for entry into another field;

means for imposing at least one requirement upon each player in turn which, if successfully accomplished, entitles that player to randomly select at least one advancement indicator;

at least one movement piece for each player to move, said piece being initially placed at said beginning location and for advancing from one playing field to another playing field upon a player placing at least one advancement indicator on said plat thereby completing said at least one indicated pattern.

* * * * *